United States Patent [19]

Kohmoto et al.

[11] 4,447,756

[45] May 8, 1984

[54] FLUORESCENT LAMP WITH LAYER OF PLURAL PHOSPHORS HAVING DIFFERENT PARTICLE SIZES

[75] Inventors: Kohtaro Kohmoto, Yokohama; Hiroyuki Ebara, Zushi; Hisami Nira, Kawasaki, all of Japan

[73] Assignee: Tokyo Shibaura Denki Kabushiki Kaisha, Kawasaki, Japan

[21] Appl. No.: 246,254

[22] Filed: Mar. 23, 1981

[30] Foreign Application Priority Data

Apr. 8, 1980 [JP] Japan ..... 55-45204

[51] Int. Cl.[3] ..... H01J 61/44; H01J 61/48

[52] U.S. Cl. ..... 313/487

[58] Field of Search ..... 313/487, 486

[56] References Cited

U.S. PATENT DOCUMENTS

| | | | |
|---|---|---|---|
| 2,181,305 | 11/1939 | Myers | 313/487 |
| 3,602,757 | 8/1971 | Wachtel | 313/487 |
| 3,602,758 | 8/1971 | Thornton et al. | 313/487 |
| 3,707,642 | 12/1972 | Thornton, Jr. . | |
| 4,088,923 | 5/1978 | Manders | 313/487 |
| 4,150,321 | 4/1979 | Schetters et al. | 313/486 |
| 4,166,234 | 8/1979 | Tak et al. | 313/486 |

FOREIGN PATENT DOCUMENTS

| | | |
|---|---|---|
| 53-867 | 1/1978 | Japan . |
| 53-56879 | 5/1978 | Japan . |

*Primary Examiner*—Palmer C. Demeo

*Attorney, Agent, or Firm*—Oblon, Fisher, Spivak, McClelland & Maier

[57] ABSTRACT

A flourescent lamp, having a vacuum tight radiation transmitting envelope comprising mercury and rare gas, provided with electrodes between which the discharge takes place during operation and a luminescent layer which comprises a mixture of phosphors having different densities wherein the greater the density of the phosphor, the smaller its particle size.

7 Claims, 1 Drawing Figure

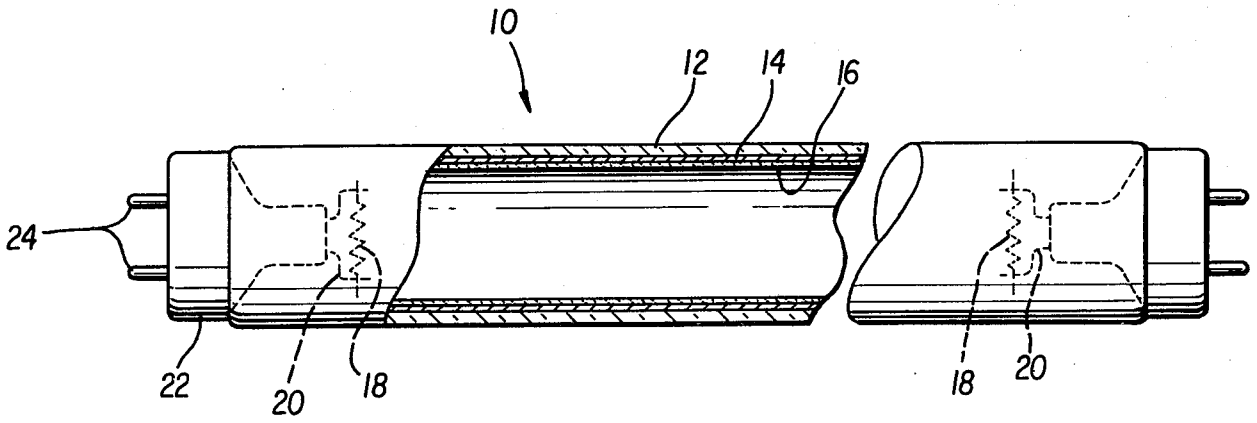
10
12
14
16
18
20
18
20
22
24

FLUORESCENT LAMP WITH LAYER OF PLURAL PHOSPHORS HAVING DIFFERENT PARTICLE SIZES

BACKGROUND OF THE INVENTION

1. Field of the Invention

This invention relates to fluorescent lamps containing a mixture of phosphors having different particle sizes.

2. Description of the Prior Art

Fluorescent lamps have been used as a general source of illumination light for many years.

In order to obtain a given desired color rendition using fluorescent lamps with a high light output, it has been proposed to blend different luminescent materials with one another or to apply them in superposed layers. For example, U.S. Pat. No. 4,088,923 describes a fluorescent lamp having two luminescent layers. In particular, the luminescent material in the layer (i.e. the first layer) more remote from the discharge is cheaper than that in other layer (i.e. the second layer). The first layer is composed of well known calciumhalophoshate phosphor. The second layer is composed of a mixture of three phosphors, i.e. blue emitting phosphor, green emitting phosphor and red emitting phosphor. The desired mixture of wave lengths is achieving by mixing the three phosphors in the proper ratio. When manufacturing fluorescent lamps on a large scale using such phosphors, there occurs the problem of uneven luminescence in the individual fluorescent lamp produced. Furthermore, there is variation in the luminescent properties from one lamp to the next in a product run.

Accordingly, a need exists for fluorescent lamps having more uniform luminescent properties.

SUMMARY OF THE INVENTION

Accordingly, an object of this invention is to provide a fluorescent lamp having even or approximately even luminescence not only within the same fluorescent lamp but also among different lamps and fluorescent lamps produced by the same procedure.

Another object of this invention is to provide high light output fluorescent lamps.

These and other objects have now been attained in this invention by providing fluorescent lamps containing a mixture of phosphors having different particle size wherein the smaller the particle size, the greater the density of the phosphor.

BRIEF DESCRIPTION OF THE DRAWING

This invention will now be described more fully with reference to the drawing.

The single FIGURE of the drawing is an elevational view, partly broken away, of a fluorescent lamp according to this invention.

DETAILED DESCRIPTION OF THE PREFERRED EMBODIMENT

Refering now to the FIGURE, reference number 10 is a fluorescent lamp having a vitreous envelope 12. The inner surface of the envelope 12 is coated with two superposed luminescent layers 14 and 16. Sealed in each end of the envelope 12 are mounts, each comprising an electrode 18, supported by lead-in wires 20. Base cap 22 and the base pins 24 are provided at the envelope 12 ends. Except for the luminescent layer 16 of this invention, the construction of the fluorescent lamp 10 is conventional, and the envelope 12 encloses a quantity of mercury and a quantity of rare gas to sustain a low pressure, ultraviolet generating discharge between the electrodes 18, during operation. Selection of the quantity of mercury and rare gases is made in the same manner as for conventional fluorescent tubes and is well known in the art.

When the luminescent layer 16 is composed of a mixture of three types of phosphors, i.e. blue emitting-phosphor, green-emitting phosphor and red-emitting phosphor, each phosphor has a different particle size, wherein the smaller particle size, the greater the density of the phosphor. Any phosphor may be used in this invention. As a blue-emitting phosphor one may select at least one from europium-activated chloride phosphate and europium-activated barium magnesium aluminate. As a green-emitting phosphor one may select at least one from the group of cerium and terbium-activated yttrium silicate, cerium and terbium-activated magnesium aluminate, cerbium and terbium-activated lanthanum phosphate and cerium and terbium-activated aluminum phosphate. As a red-emitting phosphor one may select europium-activated yttrium oxide. Because these phosphors are activated by rare earth elements, they show a high light output and desired color rendition. Additionally, the desired luminescence can be obtained by mixing three types phosphors in the proper ratio.

In using mixtures of phosphors the present inventors have found that by controlling the particle size of the phosphors it is possible to produce lamps having a greater degree of uniformity in luminescent output. In particular, the denser the phosphor, the smaller the particle size. For instance, in a three phosphor system, the densest phosphor would have the smallest particle size, the second most dense particle would have a particle size greater than the densest material but smaller than the least dense phosphor which particles would be the largest. Similar size distribution would occur in 2, 4, 5, 6, etc. phosphor mixes.

When manufacturing fluorescent lamps in an entirely conventional manner, by coating the envelope wall with a suspension of three types of phosphors having about the same particle size, the lamps yielded uneven luminescence. Namely, when coating the envelope, the upper edge portion of the envelope shows strongly red luminescence. On the other hand the lower edge portion of the envelope shows strongly green and blue luminescence. It is believed that this result is caused by the difference in sedimentation velocities owing to different particle sizes of the three types of phosphors. The formula for the sedimentation velocity is as follows:

$$4/3\pi r^3(\rho-\rho_o)g=6\pi\eta rv$$

$\rho_1\rho o$: density
g: gravity
$\eta$: coefficient of viscosity
r: particle size (a radius)
v: sedimentation velocity therefore:

$$v=2/9\cdot(\rho-\rho_o)/\eta gr^2$$

Consequently, if the particle sizes (r) of the phosphors are the same, the sedimentation velocity (v) is determined by the density ($\rho$) thereof. Thus, redemitting phosphor whose density is the greatest of the three phosphors began to sediment more than the blue and green-emitting phosphors. According to this invention, this defect can be solved by using a mixture of phosphors having different particle sizes wherein the smaller the particle size the greater the density of the phosphor.

Having generally described this invention, a further understanding can be obtained by reference to certain specific examples which are provided herein for purposes of illustration only and are not intended to be limiting unless otherwise specified.

EXAMPLE

Layer 14 is composed of manganese and antimony-activated calcium halophosphate ($3Ca_3(PO_4)_2CaF_2$/Mn,Sb). Layer 16 is composed of three types of phosphors, i.e. first phosphor A is europium-activated strontium calcium chloride phosphate ($Sr_2Ca_2(PO_4)Cl$/Eu), second phosphor B is cerium and terbium-activated yttrium silicate ($Y_2SiO_5$/Ce,Tb) and third phosphor C is europium-activated yttrium oxide ($Y_2O_3$/Eu). The density of each phosphor A, B, C are respectively 3.5, 4.9 and 5.1. The three phosphors A, B, C having different particle sizes were mixed in many ratios. The phosphors compositions thus prepared were deposited on the inner wall of an envelope of a 40 watt fluorescent lamp.

TABLE

| Number of the Lamp | Color Temp of the Lamp | Layer 16 Phosphor | Density | Particle Size (Microns) | Mixed Ratio (Weight %) | Luminous Flux | Color Luminescence |
|---|---|---|---|---|---|---|---|
| 1 | 3000K | A | 3.5 | 3.2 | 14 | 3550 | Good |
| | | B | 4.9 | 2.8 | 62 | | |
| | | C | 5.1 | 2.2 | 24 | | |
| 2 | 3000K | A | 3.5 | 4.5 | 7 | 3480 | Bad |
| | | B | 4.9 | 4.0 | 57 | | |
| | | C | 5.1 | 2.2 | 36 | | |
| 3 | 4200K | A | 3.5 | 3.2 | 14 | 3550 | Good |
| | | B | 4.9 | 2.8 | 62 | | |
| | | C | 5.1 | 2.2 | 24 | | |
| 4 | 4200K | A | 3.5 | 3.5 | 13.5 | 3600 | Good |
| | | B | 4.9 | 3.2 | 66 | | |
| | | C | 5.1 | 2.1 | 20.5 | | |
| 5 | 4200K | A | 3.5 | 4.5 | 16 | 3530 | Bad |
| | | B | 4.9 | 4.0 | 66 | | |
| | | C | 5.1 | 2.2 | 18 | | |
| 6 | 4200K | A | 3.5 | 4.5 | 14 | 3560 | Bad |
| | | B | 4.9 | 4.5 | 64 | | |
| | | C | 5.1 | 4.5 | 22 | | |
| 7 | 5000K | A | 3.5 | 3.3 | 23 | 3400 | Good |
| | | B | 4.9 | 3.0 | 62 | | |
| | | C | 5.1 | 2.0 | 15 | | |
| 8 | 5000K | A | 3.5 | 3.5 | 20 | 3450 | Bad |
| | | B | 4.9 | 3.5 | 62 | | |
| | | C | 5.1 | 4.0 | 18 | | |
| 9 | 6500K | A | 3.5 | 3.7 | 30 | 3100 | Good |
| | | B | 4.9 | 3.4 | 58 | | |
| | | C | 5.1 | 2.6 | 12 | | |
| 10 | 6500K | A | 3.5 | 3.5 | 28 | 3150 | Bad |
| | | B | 4.9 | 3.5 | 57 | | |
| | | C | 5.1 | 4.0 | 15 | | |

As shown in the above table, a color luminescence (uniformity of luminescence) is good when the phosphor particle size is varied in accordance with this invention. The denser the phosphor the smaller its particle size. In three phosphor mixtures containing blue, green and red emitting phosphors particle sizes of the first phosphor, second phosphor and third phosphor are desirably, respectively from 2.2 to 4 microns, from 2 to 3.8 microns and from 1.8 to 2.8 microns. When using a blue, green and red phosphor mixture having a ratio of by weight, i.e. first phosphor is from 10 percent to 35 percent by weight, second phosphor is from 50 percent to 70 percent by weight and third phosphors is from 10 percent to 30 percent by weight, the fluorescent lamp shows the desirable even color luminescence over from 3000 k to 6500 k color temperature of the lamp.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fluorescent lamp, having a vacuum tight radiation transmitting envelope comprising mercury and rare gas, provided with electrodes between which the discharge takes place during operation and a luminescent layer which comprises a mixture of a plurality of phosphors each having a different density and a different particle size wherein when the plurality of phosphors are ranked in order of increasing densities, then the corresponding particle size of each of said phosphors is such that said phosphors are ranked in order of decreasing particle size.

2. The fluorescent lamp of claim 1, wherein said luminescent layer is disposed directly on the inner surface of said envelope.

3. The fluorescent lamp of claim 1, wherein said luminescent layer is disposed on a different luminescent layer on said envelope.

4. The fluorescent lamp of claim 3, wherein said different luminescent layer is composed of halophosphate phosphor.

5. The fluorescent lamp of claims 1, 2, 3 or 4, wherein said luminescent layer is composed of a first phosphor, a second phosphor and a third phosphor:

said first phosphor being selected from europium-activated chloride phosphate and europium-activated barium magnesium aluminate;

said second phosphor selected from the group of cerium and terbium-activated yttrium silicate, cerium and terbium-activated magnesium aluminate and cerium and terbium-activated lanthanum phosphate and cerium cerbium activated aluminum phosphate;

and said third phosphor is europium-activated yttrium oxide.

6. The fluorescent lamp of claim 5, wherein the average particle size of said first phosphor is from 2.2 to 4 microns, the average particle size of said second phosphor is from 2 to 3.8 microns and the average particle size of said third phosphor is from 1.8 to 2.8 microns.

7. The fluorescent lamp of claim 5, wherein said luminescent layer is composed of from 10 percent to 35 percent by weight of said first phosphor, from 50 percent to 70 percent by weight of said second phosphor and from 10 percent to 30 percent by weight of said third phosphor.

* * * * *